US009470121B2

(12) United States Patent
Yu et al.

(10) Patent No.: US 9,470,121 B2
(45) Date of Patent: Oct. 18, 2016

(54) ENGINE OIL PUMP WITH REDUCED NOISE AND VIBRATION

(71) Applicants: HYUNDAI MOTOR COMPANY, Seoul (KR); Kia Motors Corporation, Seoul (KR); MYUNG HWA IND. CO., LTD., Seoul (KR)

(72) Inventors: Dong Jun Yu, Gunpo-si (KR); Min Kyu Oh, Anyang-si (KR); Hyuk In Kwon, Incheon (KR)

(73) Assignees: Hyundai Motor Company, Seoul (KR); Kia Motors Corporation, Seoul (KR); MYUNG HWA IND. CO., LTD., Seoul (KR)

( * ) Notice: Subject to any disclaimer, the term of this patent is extended or adjusted under 35 U.S.C. 154(b) by 62 days.

(21) Appl. No.: 14/562,458

(22) Filed: Dec. 5, 2014

(65) Prior Publication Data

US 2016/0003240 A1 Jan. 7, 2016

(30) Foreign Application Priority Data

Jul. 1, 2014 (KR) ..... 10-2014-0082010

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01M 1/02*** | (2006.01) |
| ***F04C 29/02*** | (2006.01) |
| ***F04C 2/10*** | (2006.01) |
| ***F04C 14/26*** | (2006.01) |
| *F04C 15/06* | (2006.01) |

(52) U.S. Cl.

CPC ..... *F01M 1/02* (2013.01); *F04C 2/102* (2013.01); *F04C 14/26* (2013.01); *F04C 29/025* (2013.01); *F04C 15/06* (2013.01)

(58) Field of Classification Search

CPC ..... F04C 2/102; F04C 14/26; F04C 15/06; F04C 29/025; F01M 1/02

USPC ..... 418/166, 171, 88, 270

See application file for complete search history.

(56) References Cited

U.S. PATENT DOCUMENTS 6,543,476 B2 * 4/2003 Kazaoka ..... F01M 1/20 137/538

2013/0209237 A1 * 8/2013 Uno ..... F04D 29/06 417/307

FOREIGN PATENT DOCUMENTS

JP 07-102930 A 4/1995

JP 09-025809 A 1/1997

(Continued)

*Primary Examiner* — Theresa Trieu

(74) *Attorney, Agent, or Firm* — McDermott Will & Emery LLP

(57) ABSTRACT

An oil pump includes a pump housing comprising an oil input port formed at one side of the pump housing. An oil output port is formed at another side of the pump housing. An oil flow unit is provided at a center of the pump housing, and the oil flow unit compresses and discharges oil input from the oil input port toward the oil output port. A bypass passage circulates the oil from the oil output port to the oil input port. A pressure control chamber allows the oil to flow through the oil output port and the bypass passage. The pressure control chamber has a plunger that is supported by an elastic body and moves in accordance with oil pressure. A bypass hole is formed at one side of the pressure control chamber and allows the oil passing through the oil output port to flow to the bypass passage when the plunger moves due to the oil pressure. The amount of oil flow increases depending on a movement distance of the plunger.

6 Claims, 3 Drawing Sheets

(56) References Cited

FOREIGN PATENT DOCUMENTS

| | | | |
|---|---|---|---|
| JP | 10-077817 | A | 3/1998 |
| JP | 2007-085192 | A | 4/2007 |
| JP | 2012-122341 | A | 6/2012 |
| KR | 1997-0027837 | A | 6/1997 |
| KR | 10-2014-0055707 | A | 5/2014 |

* cited by examiner

-- Prior Art --

ENGINE OIL PUMP WITH REDUCED NOISE AND VIBRATION

CROSS-REFERENCE(S) TO RELATED APPLICATION

The present application claims the benefit of priority to Korean Patent Application No. 10-2014-0082010, filed on Jul. 1, 2014, the entire contents of which is incorporated herein for all purposes by this reference.

TECHNICAL FIELD

The present disclosure relates to an oil pump for an engine, and more particularly, to an oil pump for an engine through which noise generation caused from pressure variation due to movement of an excessively large amount of oil flow, and vibration generation and noise caused by resonance generation of the relief valve are reduced.

BACKGROUND

Generally, an oil pump of an internal combustion engine circulates engine oil under pressure to engine components, such as rotating bearings, sliding pistons, camshaft, and the like to reduce friction between the components while the engine is running, thereby providing smooth engine operation.

Recently, technology for reducing friction between engine components and improving fuel efficiency has been developed, while the engine is running using a low friction mechanism such as continuously variable valve timing (CVVT) and continuously variable lift (CVVL).

In particular, a directly-connected type engine oil pump in which an oil pump of an internal combustion engine is directly connected to a crankshaft has been used to reduce friction, and thus improve fuel efficiency and reduce cost in comparison to an indirectly connected engine oil pump that is driven by a chain connected to a crankshaft.

In a conventional oil pump, as shown in FIG. 1, an inner rotor 5 and an outer rotor 7 are provided at a center of a pump housing 10 where an intake port 1 and a discharging port 3 are provided. The oil within an oil fan is drawn into the pump housing by negative pressure caused by a volume change when the inner rotor 5 and the outer rotor 7 rotate. The oil that is drawn in is compressed to a high pressure and then discharged to the discharging port due to a volume change, and then provided to engine components.

The oil pressure in the oil pump of the engine, which is discharged, increases in proportion to the number of engine reciprocation. When the oil pressure increases excessively durability of the engine components may be degraded. A relief valve 9 is provided on the oil pump to prevent this excessive increase of the oil pressure, and the oil is bypassed when the relief valve 9 is opened in accordance with the oil pressure.

In the related art, an excessively large amount of oil flow is bypassed instantly due to the excessive oil pressure when the relief valve 9 operates, and thus, the discharge pressure of the oil increases to induce resonance of the relief valve.

In addition, the oil within the engine oil pump may leak when the oil pump is not operated for a long time, thus generating resonance in the relief valve when it initially starts.

The description provided above as a related art of the present disclosure is just for helping in understanding the background of the present disclosure and should not be construed as being included in the related art known by those skilled in the art.

SUMMARY

The present disclosure has been made in an effort to solve the above problems, and an aspect of the present inventive concept provides an oil pump for an internal combustion engine, through which noise generation is prevented, caused by pressure variation due to movement of an excessively large amount of oil flow when a relief valve is operated. Vibration and noise generation caused by resonance generation of the relief valve at an initial starting-on stage is reduced.

According to an exemplary embodiment of the present inventive concept, an oil pump is provided comprising a pump housing including an oil input port formed at one side of the pump housing, and an oil output port formed at another side of the pump housing. An oil flow unit for compressing and discharging oil input from the oil input port toward the oil output port is provided at a center of the pump housing. A bypass passage circulates oil from the oil output port to the oil input port. A pressure control chamber allows the oil to flow through the oil output port and the bypass passage, wherein the oil pressure control chamber has a plunger that is supported by an elastic body and moves in accordance with oil pressure. A bypass hole is formed at one side of the pressure control chamber and allows the oil passing through the oil output port to flow to the bypass passage when the plunger moves due to the oil pressure. The amount of oil flow increases depending on a movement distance of the plunger.

The bypass hole may have a width that gradually increases toward a direction to which the plunger is pressed-in by the oil pressure.

A section of the bypass hole may have a shape that is tapered toward the pressed-in direction of the plunger so that a width of the bypass hole gradually increases toward the pressed-in direction.

The pressure control chamber may further include a drain hole on a side of the pressure control chamber. The drain hole is disposed on a lower part of the plunger relative to the bypass hole and spaced apart each at a constant interval from the bypass hole such that the oil filled in the lower part of the plunger flows to the bypass passage.

A baffle may extend upwardly toward the bypass hole at one side of the drain hole which is formed in the pressure control chamber on the bypass passage.

The baffle may extend upward and away from the one side of the drain hole which is formed in the pressure control chamber on the bypass passage to form a filling flow passage together with an inner wall of the pump housing.

The drain hole may be disposed at a lowest side of the filling flow passage.

BRIEF DESCRIPTION OF THE DRAWINGS

The above and other features of the present inventive concept will now be described in detail with reference to exemplary embodiments thereof by illustrating the accompanying drawings which are given herein below by way of illustration only, and thus are not limitative of the present disclosure.

Figure 1:
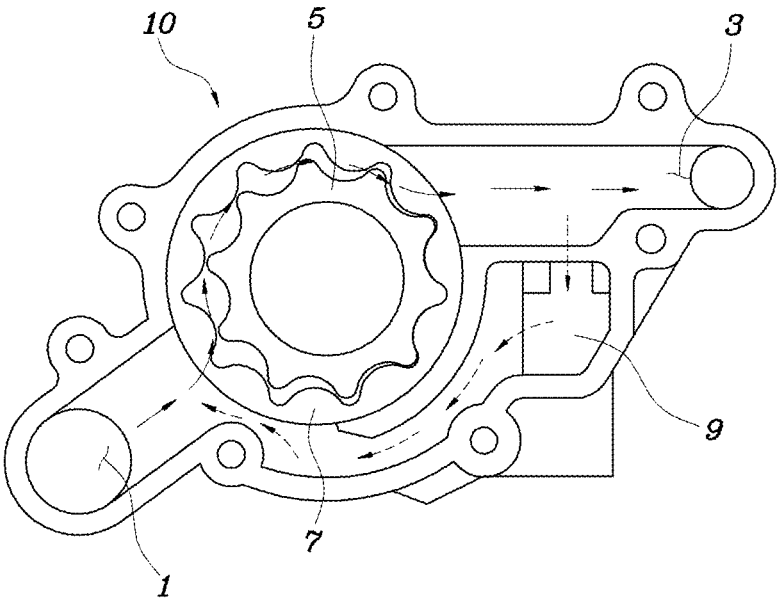
FIG. 1 is a view illustrating schematically a conventional oil pump of an internal combustion engine.

It should be understood that the appended drawings are not necessarily to scale, presenting a somewhat simplified representation of various exemplary features of the present inventive concept as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter reference will now be made in detail to various embodiments of the present inventive concept, examples of which are illustrated in the accompanying drawings and described below. While the disclosure will be described in conjunction with exemplary embodiments, it will be understood that the present description is not intended to limit the invention to those exemplary embodiments. On the contrary, the inventive concept is intended to cover the exemplary embodiments as well as various alternatives, modifications, equivalents, and other embodiments; which may be included within the spirit and scope of the invention as defined by the appended claims.

It is understood that the term "vehicle" or "vehicular" or other similar term as used herein is inclusive of motor vehicles in general, such as passenger automobiles including: sports utility vehicles (SUV), buses, trucks; and various commercial vehicles; watercraft including: a variety of boats and ships; aircraft and the like; and includes hybrid vehicles, electric vehicles, plug-in hybrid electric vehicles, hydrogen-powered vehicles, and other alternative fuel vehicles (e.g. fuels derived from resources other than petroleum). As referred to herein, a hybrid vehicle is a vehicle that has two or more sources of power, for example, both gasoline-powered and electric-powered vehicles.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, an oil pump of an engine according to the preferred embodiment of the present invention will be described with reference to the accompanying drawings.

Figure 2:
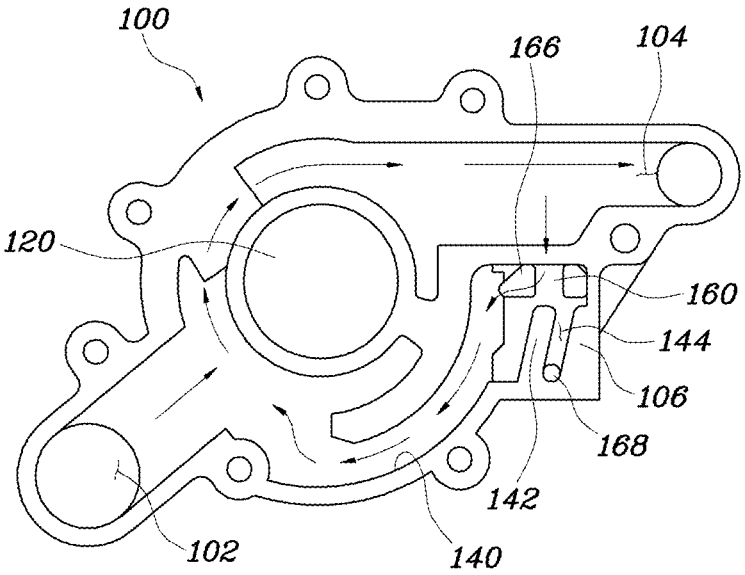
FIG. 2 is a view illustrating schematically an oil pump of an internal combustion engine according to an embodiment of the present inventive concept.
Figure 3:
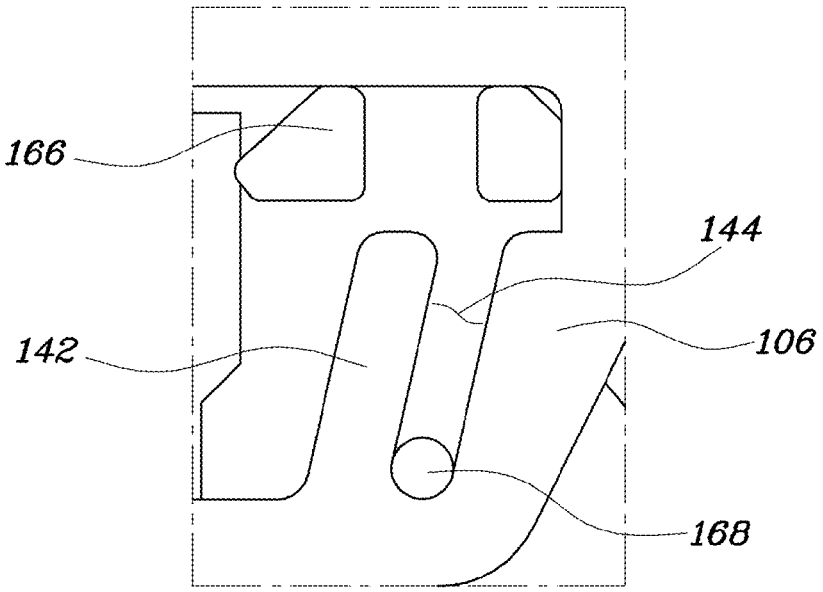
FIG. 3 is a view illustrating a baffle at sides of a bypass hole and a drain hole of the oil pump of an engine shown in FIG. 2.
Figure 4:
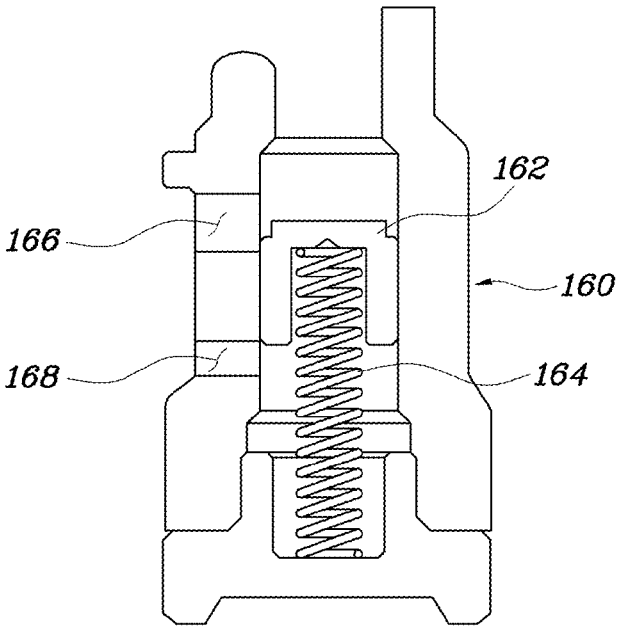
FIG. 4 is a view illustrating a pressure control chamber of the oil pump of an engine shown in FIG. 2.
Figure 5:
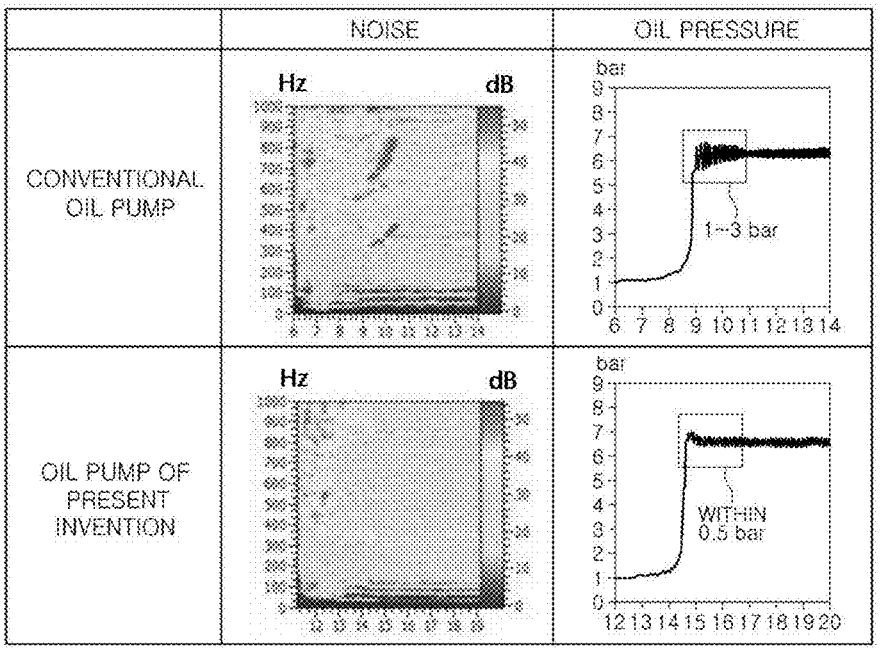
FIG. 5 is a view showing differences in generations of noise and pressure between a conventional oil pump of an engine and an oil pump of an engine of the present inventive concept.

FIG. 2 is a view illustrating schematically an oil pump of an engine according to an embodiment of the present inventive concept; FIG. 3 is a view illustrating a baffle at sides of a bypass hole and a drain hole of the oil pump of an engine as shown in FIG. 2; FIG. 4 is a view illustrating a pressure control chamber of the oil pump of an engine as shown in FIG. 2; and FIG. 5 is a view showing differences in generations of noise and pressure between a conventional oil pump of an engine and an oil pump of an engine of the present inventive concept.

An oil pump of an engine according to an embodiment of the present disclosure may include a pump housing 100 at one side of which an oil input port 102 is formed and at another side of which an oil output port 104 is formed. An oil flow unit 120 for compressing and outputting oil input from the oil input port 102 toward the oil output port 104 is provided at a center of the pump housing 100. A bypass passage 140 is formed to circulate the oil from the oil output port 104 to the oil input port 102. A pressure control chamber 160 is provided to flow the oil through the oil output port 104 and the bypass passage 140. A plunger 162 that is supported by an elastic body 164 and moves in accordance with oil pressure is provided in the pressure control chamber 160. A bypass hole 166 is formed at one side of the pressure control chamber 160 and allows the oil passing through the oil output port 104 to flow to the bypass passage 140 when the plunger 162 moves due to the oil pressure. The amount of oil flow increases depending on the movement distance of the plunger 162.

As shown in FIG. 2, the oil output port 104 through which oil is discharged is formed diagonally with respect to the oil input port 102 through which the oil is input from an oil fan (not indicated) in the pump housing 100. Further, the oil flow unit 120 is provided at the center of the pump housing 100 to compress the oil flowing in the pump housing 100, thereby to increase the oil pressure and then to discharge the oil to the oil output port 104. Here, the oil flow unit 120 has an inner rotor and an outer rotor (not shown) for discharging the oil by volume change thereof, wherein the detailed configurations of an oil pump for outputting lubricant oil are disclosed variously through prior documents, and thus, descriptions thereof are omitted.

The bypass passage 140 is formed in the pump housing 100 such that the oil circulates from the oil output port 104 to the oil input port 102. Here, the pressure control chamber 160 is disposed between the oil output port 104 and the bypass passage 140, and the plunger 162 and the elastic body 164 in the pressure control chamber 160 move by the oil pressure.

When the plunger 162 moves by the oil pressure as described above, the bypass hole 166 formed on one side of the pressure control chamber 160 is opened so that the oil passing through the oil output port 104 flows to the bypass passage 140 thereby to control pressure of oil that is discharged.

According to an embodiment of the present inventive concept, the bypass hole 166 is formed such that the oil passing through the oil output port 104 flows to the bypass passage 140, and at the same time, the amount of oil flow increases in accordance with the movement distance of the plunger 162.

That is, when pressure at a side of the oil output port 104 increases to a set pressure, the plunger 162 moves downwardly. When the plunger moves downwards, according to related art, the amount of oil flow is bypassed instantly and excessively, and thus, the variation of oil discharging pressure is increased, thereby generating noise and vibration.

However, according to an embodiment of the present inventive concept, when the plunger 162 moves downwardly, the amount of oil flow that is bypassed is small at an initial stage, and when the movement distance of the plunger 162 becomes greater as pressure of the discharging oil passing through the oil output port 104 increases, the amount of oil flow that is bypassed increases, thereby resolving sudden pressure variation and reducing noise and vibration.

In more detail, the bypass hole 166 has a shape in which a width thereof gradually increases toward a direction to which the plunger 162 is pressed-in by the oil pressure. That is, a section of the bypass hole 166 is tapered toward the pressed-in direction of the plunger 162 so that the width of the bypass hole 166 gradually increases in the downward direction.

As a result, when the movement distance of the plunger 162 gradually increases as the pressure of the discharging oil passing through the oil output port 104 increases, the bypass hole 166 is gradually opened, such that the width thereof gradually increases in the downward direction so that the amount of oil flow increases in accordance with the movement distance of the plunger 162.

As described above, the bypass hole 166 is formed such that the amount of oil flow that is bypassed gradually increases as the movement distance of the plunger 162 increases, thus sudden excessive pressure variation of oil due to sudden flow of oil is prevented, when controlling the pressure of the oil that is discharged, thereby improving noise, vibration and hardness (NVH) performance.

A drain hole 168 may be formed on a side of the pressure control chamber 160, which is disposed on a lower part of the plunger 162 and spaced at a constant interval from the bypass hole 166, such that the oil filled in a lower part of the plunger 162 flows to the bypass passage 140.

That is, the plunger 162 is elastically supported by the elastic body 164 in the pressure control chamber 160 and moves downwardly when the pressure of oil passing through the oil output port 104 reaches to a set pressure. Here, the oil flows not only to the elastic body 164 and but also to a gap between an internal surface of the pressure control chamber 160 and the plunger 162 to be filled in the lower part of the plunger 162.

As described above, in a case where the oil filled in the lower part of the plunger 162 is not discharged, even though the oil pressure at a side of the oil output port 104 reaches a set pressure, the plunger 162 does not move downward due to the oil in the lower part of the plunger 162. The drain hole 168 is formed in the pressure control chamber 160 such that the oil filled in the lower part of the plunger 162 is discharged therethrough.

The oil filled in the lower part of the plunger 162 dampens the plunger 162 to provide smooth movement. However, when a vehicle does not run with the oil filled in the lower part of the plunger 162 for a long time, the oil is discharged to the bypass passage 140 through the drain hole 168 to thereby remove an internal damping operation. Under this situation in a case where pressure is applied to the plunger 162 due to the discharging pressure of oil when starting the vehicle, noise and vibration may be generated.

In order to solve this problem according to an embodiment of the present inventive concept, as shown in FIG. 3, a baffle 142 formed in the pressure control chamber 160 extends from the bypass passage toward one side of the drain hole 168.

The baffle 142 extends upward from the one side of the drain hole 168 which is formed in the pressure control chamber 160 on the bypass passage 140 to form a filling flow passage 144 together with an inner wall of the pump housing 100. Here, The oil pump cover to be connected to a side surface of the pump housing 100 has a protruded section to be contacted with a flat surface of the baffle 142 when assembled, such that the filling flow passage 144 is formed with the baffle 142, the inner wall 106 of the pump housing 100 and the protruded section of the oil pump cover, when the oil pump is fully assembled.

That is, according to an embodiment of the present disclosure, the baffle 142 extends to one side of the drain hole 168 on the bypass passage 140 to form the filling flow passage 144 such that oil is discharged through the drain hole 168 of the pressure control chamber 160, not to flow to the bypass passage 140, but to remain in the filling flow passage 144, thereby keeping the oil filled in the lower part of the plunger 162.

As described above, the oil is kept in the pressure control chamber 160 through the filling flow passage 144 formed by the baffle 142 so that even when a vehicle is stationary with the oil filled in the pressure control chamber 160 for a long time, since the oil is kept in the lower part of the plunger 162, the plunger 162 can be dampened with the oil when the engine starts running, to prevent resonance, thereby improving NVH performance.

The baffle 142 extends upwardly from the inner wall 106 of the pump housing 100 to form the filling flow passage 144 including the drain hole 168 wherein the drain hole 168 is disposed at the lowest side of the filling flow passage 144.

That is, the drain hole 168 formed in the pressure control chamber 160 is disposed at the lowest side of the filling flow passage 144 formed by the baffle 142 so that a sufficient amount of oil flow remained in the filling flow passage 144 can be ensured. Further, the oil discharged through the drain hole 168 moves upwardly from the lowest side of the filling flow passage 144 and then flows to the bypass passage 140, thereby continuously circulating oil through the filling flow passage 144.

FIG. 5 is a view showing differences in generations of noise and pressure between a conventional oil pump of an engine and an oil pump of an engine of the present inventive concept as described above, when staring the vehicle.

According to a conventional oil pump, it is shown that when the engine starts while the oil in the lower part of the plunger 162 of the pressure control chamber 160 leaks out in a vehicle is left stationary for a long time, pressure variation of oil is great as 1-3 bar due to resonance as a damping effect with oil is removed. As a result, surging noise is generated at frequencies of 300-400 Hz and 600-800 Hz.

However, according to an embodiment of the present inventive concept, it is shown that the oil is maintained at a lower part of the plunger 162 of the pressure control chamber 160, and thus, the damping effect of the oil is maintained so that the pressure variation of oil is reduced greatly to 0.5 bar when the engine starts, and further the noise generation is resolved, thereby improving NVH performance.

According to the oil pump configured as described above, the amount of oil flow that is bypassed through the bypass hole gradually increases by controlling oil pressure, thereby minimizing generation of pressure variation due to the excessive amount of oil flow.

Furthermore, according to the oil pump of the present inventive concept, oil is ensured at a predetermined level through the filling flow passage formed by the baffle so that the d oil serves to dampen the plunger even when a vehicle is stopped for a long time, thereby reducing resonance.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. An oil pump, comprising:

a pump housing including:

an oil input port formed at one side of the pump housing;

an oil output port formed at another side of the pump housing; and an oil flow unit provided at a center of the pump housing, wherein the oil flow unit compresses and discharges oil input from the oil input port toward the oil output port;

a bypass passage for circulating the oil from the oil output port to the oil input port;

a pressure control chamber for allowing the oil to flow through the oil output port and the bypass passage, wherein the pressure control chamber has a plunger that is supported by an elastic body and moves in accordance with oil pressure; and a bypass hole formed at one side of the pressure control chamber and allows the oil passing through the oil output port to flow to the bypass passage when the plunger moves due to the oil pressure, wherein the amount of oil flow increases depending on a movement distance of the plunger, wherein the pressure control chamber further includes a drain hole formed on a side of the pressure control chamber, wherein the drain hole is disposed on a lower part of the plunger relative to the bypass hole, and spaced apart at a constant interval from the bypass hole such that the oil filled in the lower part of the plunger flows to the bypass passage, and wherein the bypass passage comprises a baffle extending upwardly along one side of the drain hole formed in the pressure control chamber.

2. The oil pump of claim 1, wherein the bypass hole has a width that gradually increases toward a direction to which the plunger is pressed-in by the oil pressure.

3. The oil pump of claim 1, wherein a section of the bypass hole has a shape that is tapered toward a pressed-in direction of the plunger so that a width of the bypass hole increases toward the pressed-in direction.

4. The oil pump of claim 1, wherein the baffle extends upwardly along the one side of the drain hole formed in the pressure control chamber on the bypass passage to form a filling flow passage together with an inner wall of the pump housing.

5. The oil pump of claim 4, wherein the drain hole is disposed at a lowest portion of the filling flow passage.

6. The oil pump of claim 1, wherein the oil filled in the lower part of the plunger serves as a damper for dampening the plunger.

* * * * *